US008932036B2

(12) United States Patent
Monnier et al.

(10) Patent No.: US 8,932,036 B2
(45) Date of Patent: Jan. 13, 2015

(54) COMPRESSOR SEAL ASSEMBLY

(75) Inventors: Kenneth J. Monnier, Maplewood, OH (US); Dennis D. Pax, Piqua, OH (US); Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 477 days.

(21) Appl. No.: 13/283,097

(22) Filed: Oct. 27, 2011

(65) Prior Publication Data

US 2012/0107163 A1 May 3, 2012

Related U.S. Application Data

(60) Provisional application No. 61/407,781, filed on Oct. 28, 2010.

(51) Int. Cl.
*F03C 2/00* (2006.01)
*F03C 4/00* (2006.01)
(Continued)

(52) U.S. Cl.
CPC ..... *F04C 18/0215* (2013.01); *F04C 23/008* (2013.01); *F04C 27/001* (2013.01); *F04C 27/008* (2013.01)
USPC ..... 418/55.4; 418/1; 418/55.5; 418/57; 418/86; 418/270

(58) Field of Classification Search
CPC .. F04C 18/0215; F04C 23/008; F04C 27/005; F04C 29/0007; F01C 1/0215; F01C 20/10; F01C 20/12; F01C 21/06
USPC ..... 418/1, 55.1–55.6, 57, 86, 270
See application file for complete search history.

(56) References Cited

U.S. PATENT DOCUMENTS 2,294,105 A 8/1942 Wallgren
2,867,462 A 1/1959 Nielsen
(Continued)

FOREIGN PATENT DOCUMENTS

EP 0482209 A1 4/1992
EP 0747598 A2 12/1996
JP 05149269 6/1993

OTHER PUBLICATIONS

European Search Report for Application No. EP 06 25 0074, dated Jun. 13, 2006.
(Continued)

*Primary Examiner* — Theresa Trieu
(74) *Attorney, Agent, or Firm* — Harness, Dickey & Pierce, P.L.C.

(57) ABSTRACT

A compressor may include a shell, first and second scroll members, and a seal assembly. The shell defines a first and second pressure regions. The first scroll member may include a first end plate defining a chamber. The seal assembly may surround the discharge passage and fluidly separate the first and second pressure regions from each other. The seal assembly may include first and second sealing members. The first sealing member may prevent communication between the chamber and the second pressure region when a first fluid pressure within the second pressure region is higher than a second fluid pressure within the chamber. The first sealing member may define a leakage path when the first fluid pressure is lower than the second fluid pressure. The second sealing member may fluidly separate the chamber and the second pressure region when the first fluid pressure is lower than the second fluid pressure.

29 Claims, 7 Drawing Sheets

(51) Int. Cl.

| | |
|---|---|
| ***F04C 2/00*** | (2006.01) |
| ***F04C 18/02*** | (2006.01) |
| ***F04C 23/00*** | (2006.01) |
| ***F04C 27/00*** | (2006.01) |

(56) References Cited

U.S. PATENT DOCUMENTS

| | | | | |
|---|---|---|---|---|
| 3,306,683 | A | | 2/1967 | Deuring |
| 3,511,512 | A | | 5/1970 | Wheelock |
| 3,600,114 | A | | 8/1971 | Dvorak et al. |
| 3,707,852 | A | | 1/1973 | Burckhardt et al. |
| 4,116,452 | A | | 9/1978 | Schanz |
| 4,596,520 | A | | 6/1986 | Arata et al. |
| 4,655,462 | A | | 4/1987 | Balsells |
| 4,669,737 | A | | 6/1987 | Diffenderfer |
| 4,869,514 | A | | 9/1989 | Bogdanovic |
| 4,877,382 | A | | 10/1989 | Caillat et al. |
| 4,940,080 | A | | 7/1990 | Reeves et al. |
| 4,993,928 | A | | 2/1991 | Fraser, Jr. |
| 5,105,879 | A | | 4/1992 | Ross |
| 5,156,539 | A | | 10/1992 | Anderson et al. |
| 5,311,748 | A | * | 5/1994 | Bahel et al. ..... 62/160 |
| 5,494,422 | A | | 2/1996 | Ukai et al. |
| 5,503,542 | A | | 4/1996 | Grassbaugh et al. |
| 5,588,820 | A | | 12/1996 | Hill et al. |
| 5,607,288 | A | * | 3/1997 | Wallis et al. ..... 418/55.5 |
| 5,707,210 | A | | 1/1998 | Ramsey et al. |
| 5,800,141 | A | | 9/1998 | Ceylan et al. |
| 5,803,716 | A | | 9/1998 | Wallis et al. |
| 5,921,761 | A | | 7/1999 | Eckels |
| 6,027,321 | A | | 2/2000 | Shim et al. |
| 6,095,765 | A | | 8/2000 | Khalifa |
| 6,267,565 | B1 | | 7/2001 | Seibel et al. |
| 6,821,092 | B1 | | 11/2004 | Gehret et al. |
| 6,913,448 | B2 | | 7/2005 | Liang et al. |
| 6,984,115 | B1 | | 1/2006 | Tarng et al. |
| 7,338,265 | B2 | | 3/2008 | Grassbaugh et al. |
| 2002/0026806 | A1 | | 3/2002 | Tsuboe et al. |
| 2003/0012659 | A1 | | 1/2003 | Seibel et al. |
| 2003/0063982 | A1 | | 4/2003 | Pham |
| 2009/0185935 | A1 | * | 7/2009 | Seibel et al. ..... 418/55.4 |

OTHER PUBLICATIONS

International Search Report regarding Application No. PCT/US2011/058128, dated Apr. 10, 2012.

Written Opinion of the International Searching Authority regarding Application No. PCT/US2011/058128, dated Apr. 10, 2012.

Office Action regarding Russia Application No. 2013124425 dated Jun. 9, 2013. Translation provided by Gowlings International Inc.

* cited by examiner

COMPRESSOR SEAL ASSEMBLY

CROSS-REFERENCE TO RELATED APPLICATIONS

This application claims the benefit of U.S. Provisional Application No. 61/407,781, filed on Oct. 28, 2010. The entire disclosure of the above application is incorporated herein by reference.

FIELD

The present disclosure relates to a compressor, and more particularly to a seal assembly for a compressor.

BACKGROUND

This section provides background information related to the present disclosure and is not necessarily prior art.

Heat-pump systems and other working fluid circulation systems include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the heat-pump system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a shell, first and second scroll members, and a seal assembly. The shell may define a first pressure region and a second pressure region. The first scroll member may be disposed within the shell and may include a first end plate and a first scroll wrap. The first end plate may define a biasing chamber and a discharge passage in communication with the second pressure region. The second scroll member may include a second end plate and a second scroll wrap. The second scroll wrap may meshingly engage the first scroll wrap to define a compression chamber therebetween.

The seal assembly may surround the discharge passage and fluidly separate the biasing chamber from the first and second pressure regions. The seal assembly may surround the discharge passage and fluidly separate the first and second pressure regions from each other. The seal assembly may include a first sealing member and a second sealing member. The first sealing member may prevent communication between the biasing chamber and the second pressure region when a first fluid pressure within the second pressure region is higher than a second fluid pressure within the biasing chamber. The first sealing member may define a leakage path when the first fluid pressure is lower than the second fluid pressure. The second sealing member may fluidly separate the biasing chamber and the second pressure region when the first fluid pressure is lower than the second fluid pressure.

In another form, the present disclosure provides a method that may include providing a fluid circulation system including a compressor, an indoor heat exchanger and an outdoor heat exchanger. The compressor may include first and second pressure regions, a first scroll member and a second scroll member meshingly engaging the first scroll member. The first scroll member may define a fluid chamber and a discharge passage in communication with the second pressure region. A seal assembly may be provided that may at least partially define the fluid chamber and may include first and second sealing members. The second pressure region may be fluidly separated from the fluid chamber using the first sealing member when the compressor is operating in a steady-state condition. The compressor may also operate in a transitional condition in which the second pressure region is at a fluid pressure that is less than a fluid pressure of the first pressure region. A leakage path around the first sealing member may be provided when the compressor is operating in the transitional condition. The second pressure region may be fluidly separated from the fluid chamber using the second sealing member when the compressor is operating in the transitional condition.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
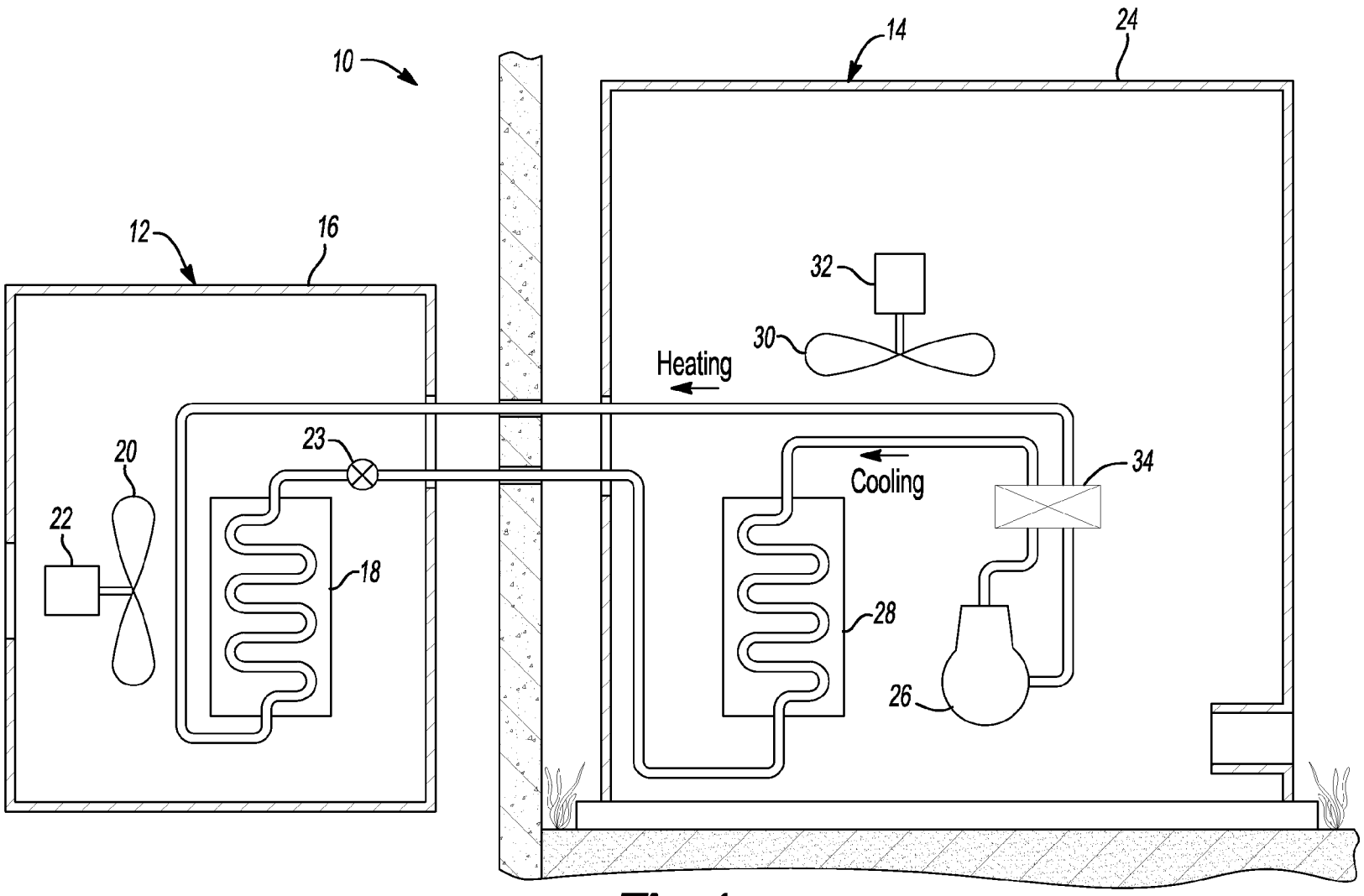
FIG. 1 is a schematic representation of a fluid circulation system including a compressor according to the principles of the present disclosure.
Figure 2:
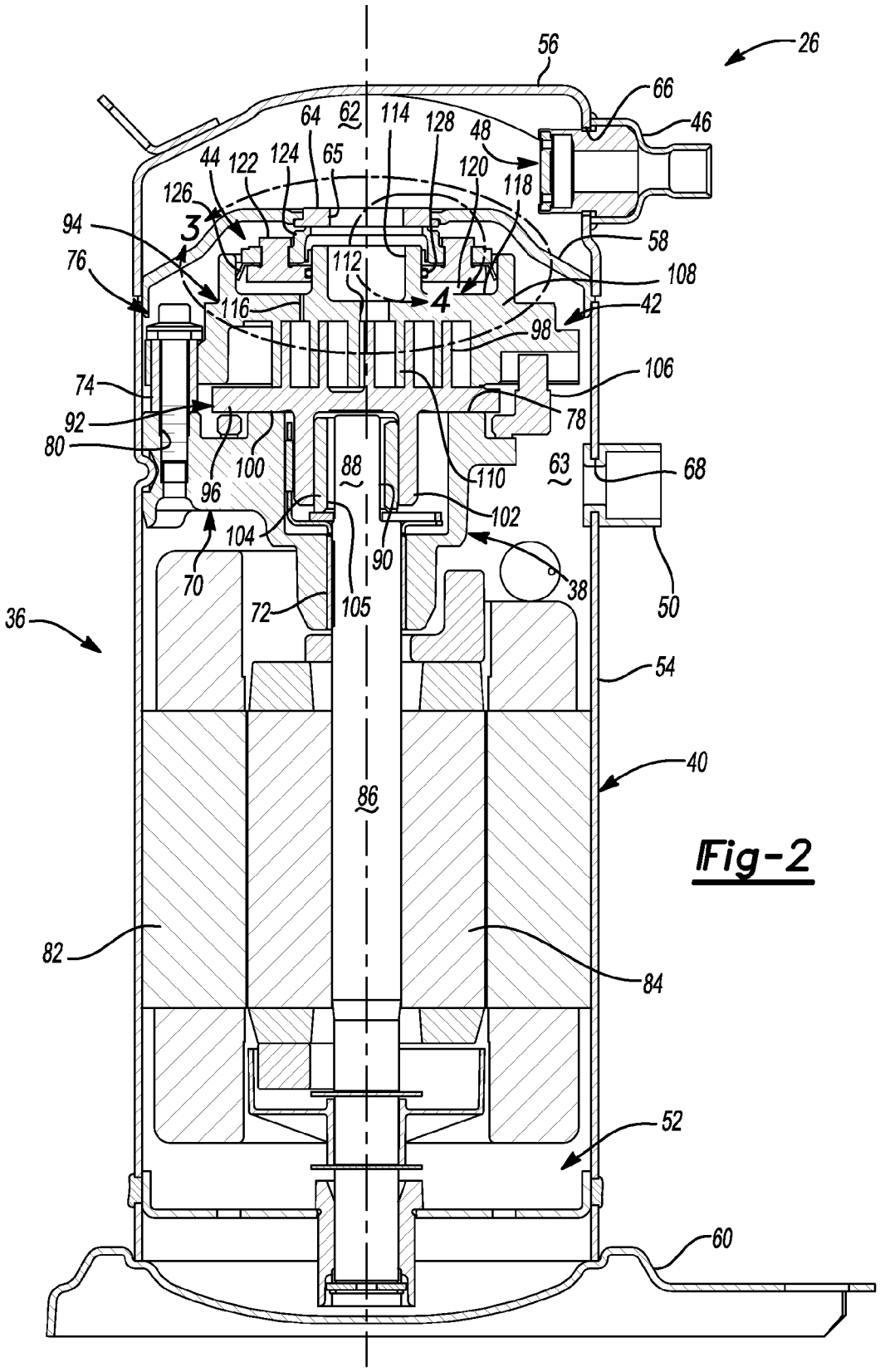
FIG. 2 is a cross-sectional view of the compressor of FIG. 1 having a seal assembly according to the principles of the present disclosure.
Figure 3:
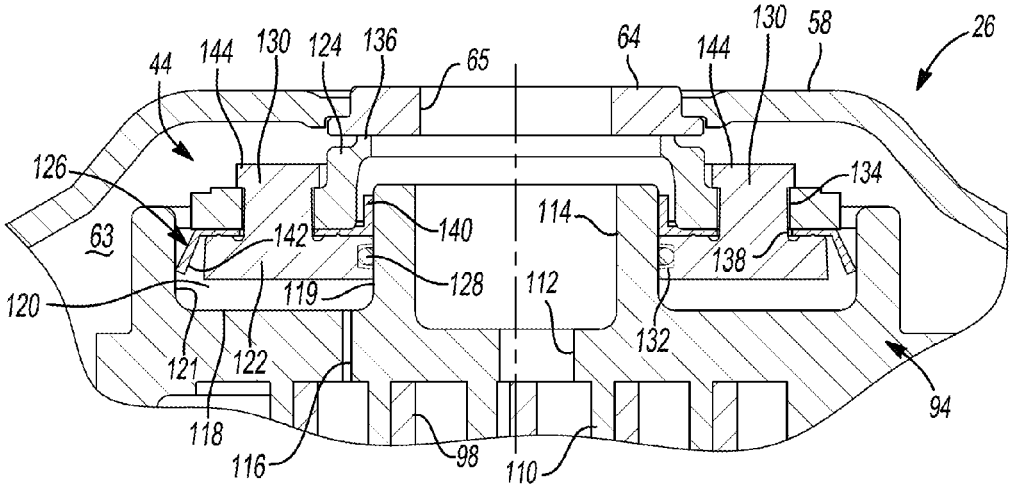
FIG. 3 is a cross-sectional view of the seal assembly of FIG. 2.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a fluid circulation system such as a heat pump system 10 is provided and may include an indoor unit 12 and an outdoor unit 14. The heat pump system 10 is operable to circulate a working fluid such as a refrigerant or carbon dioxide between the indoor and outdoor units 12, 14 to heat or cool a space on demand.

The indoor unit 12 may include a first casing 16 housing an indoor coil or heat exchanger 18, a variable speed indoor fan 20, a motor 22 driving the indoor fan 20, and an expansion device 23. The indoor fan 20 forces ambient air across the indoor heat exchanger 18 to facilitate heat transfer between the ambient air and the working fluid flowing through the indoor heat exchanger 18.

The outdoor unit 14 may include a second casing 24 housing a compressor 26, an outdoor coil or heat exchanger 28, a variable speed outdoor fan 30, a motor 32 driving the outdoor fan 30, and a reversing valve 34. The outdoor fan 30 forces ambient air across the outdoor heat exchanger 28 to facilitate heat transfer between the ambient air and the working fluid flowing through the outdoor heat exchanger 28. The reversing valve 34 may be disposed between the compressor 26 and the indoor and outdoor heat exchangers 18, 28 and may control a direction of fluid flow through the heat pump system 10.

The compressor 26 is in fluid communication with the indoor and outdoor heat exchangers 18, 28 and circulates the working fluid therebetween. The compressor 26 may include a hermetic shell assembly 36, a first bearing housing assembly 38, a motor assembly 40, a compression mechanism 42, a seal assembly 44, a discharge fitting 46, a discharge valve assembly 48, a suction inlet fitting 50, and a second bearing housing assembly 52.

The shell assembly 36 may form a compressor housing and may include a cylindrical shell 54, an end cap 56 at an upper end thereof, a transversely extending partition 58, and a base 60 at a lower end thereof. The end cap 56 and the partition 58 may define a discharge chamber 62. The partition 58 may separate the discharge chamber 62 from a suction chamber 63. The partition 58 may include a wear ring 64 and a discharge passage 65 extending therethrough to provide communication between the compression mechanism 42 and the discharge chamber 62. The discharge fitting 46 may be attached to shell assembly 36 at an opening 66 in the end cap 56. The discharge valve assembly 48 may be disposed within the discharge fitting 46 and may generally prevent a reverse flow condition. The suction inlet fitting 50 may be attached to shell assembly 36 at an opening 68.

The first bearing housing assembly 38 may be fixed relative to the shell 54 and may include a main bearing housing 70, a first bearing 72, sleeves guides or bushings 74, and fastener assemblies 76. The main bearing housing 70 may house the first bearing 72 therein and may define an annular flat thrust bearing surface 78 on an axial end surface thereof. The main bearing housing 70 may include apertures 80 extending therethrough and receiving the fastener assemblies 76.

The motor assembly 40 may include a motor stator 82, a rotor 84, and a drive shaft 86. The motor stator 82 may be press fit into the shell 54. The rotor 84 may be press fit on the drive shaft 86 and may transmit rotational power to the drive shaft 86. The drive shaft 86 may be rotatably supported within the first and second bearing housing assemblies 38, 52. The drive shaft 86 may include an eccentric crank pin 88 having a flat 90 thereon.

The compression mechanism 42 may include an orbiting scroll 92 and a non-orbiting scroll 94. The orbiting scroll 92 may include an end plate 96 having a spiral wrap 98 on an upper surface thereof and an annular flat thrust surface 100 on a lower surface. The thrust surface 100 may interface with the annular flat thrust bearing surface 78 on the main bearing housing 70. A cylindrical hub 102 may project downwardly from thrust surface 100 and may include a drive bushing 104 disposed therein. The drive bushing 104 may include an inner bore 105 in which the crank pin 88 is drivingly disposed. The crank pin flat 90 may drivingly engage a flat surface in a portion of the inner bore 105 to provide a radially compliant driving arrangement. An Oldham coupling 106 may be engaged with the orbiting and non-orbiting scrolls 92, 94 to prevent relative rotation therebetween.

The non-orbiting scroll 94 may include an end plate 108 and a spiral wrap 110 projecting downwardly from the end plate 108. The spiral wrap 110 may meshingly engage the spiral wrap 98 of the orbiting scroll 92, thereby creating a series of moving fluid pockets. The fluid pockets defined by the spiral wraps 98, 110 may decrease in volume as they move from a radially outer position (at a suction pressure) to a radially intermediate position (at an intermediate pressure) to a radially inner position (at a discharge pressure) throughout a compression cycle of the compression mechanism 42.

The end plate 108 may include a discharge passage 112, a discharge recess 114, an intermediate passage 116, and an annular recess 118. The discharge passage 112 is in communication with one of the fluid pockets at the radially inner position and allows compressed working fluid (at the discharge pressure) to flow through the discharge recess 114 and into the discharge chamber 62. The intermediate passage 116 may provide communication between one of the fluid pockets at the radially intermediate position and the annular recess 118. The annular recess 118 may encircle the discharge recess 114 and may be substantially concentric therewith. The annular recess 118 may include an inner surface 119 and an outer surface 121.

The annular recess 118 may at least partially receive the seal assembly 44 and may cooperate with the seal assembly 44 to define an axial biasing chamber 120 therebetween. The biasing chamber 120 receives fluid from the fluid pocket in the intermediate position through the intermediate passage 116. A pressure differential between the intermediate-pressure fluid in the biasing chamber 120 and fluid in the suction chamber 63 exerts a net axial biasing force on the non-orbiting scroll 94 urging the non-orbiting scroll 94 toward the orbiting scroll 92. In this manner, the tips of the spiral wrap 110 of the non-orbiting scroll 94 are urged into sealing engagement with the end plate 96 of the orbiting scroll 92 and the end plate 108 of the non-orbiting scroll 94 is urged into sealing engagement with the tips of the spiral wrap 98 of the orbiting scroll 92.

The seal assembly 44 may include an annular base plate 122, a first annular sealing member 126, a second annular sealing member 128, and a third annular sealing member 124. The annular base plate 122 may include a plurality of axially extending projections 130 and an annular groove 132. The annular groove 132 may include a generally rectangular or trapezoidal cross section, for example, and may receive the second annular sealing member 128. The third annular sealing member 124 may include a plurality of apertures 134 and a lip portion 136 that sealingly engages the wear ring 64. The first annular sealing member 126 may include a plurality of apertures 138, a generally upwardly extending inner portion 140, and a generally outwardly and downwardly extending outer portion 142. The inner portion 140 may sealingly engage the inner surface 119 of the annular recess 118, and the outer portion 142 may sealingly engage the outer surface 121 of the annular recess 118.

Each of the plurality of axially extending projections 130 of the annular base plate 122 engage a corresponding one of the apertures 134 in the third annular sealing member 124 and a corresponding one of the apertures 138 in the first annular sealing member 126. Ends 144 of the projections 130 may be swaged or otherwise deformed to secure the third and first annular sealing members 124, 126 to the annular base plate 122. In some configurations, additional or alternative means may be employed to secure the third annular sealing member 124 to the annular base plate 122, such as threaded fasteners and/or welding, for example.

Figure 4:
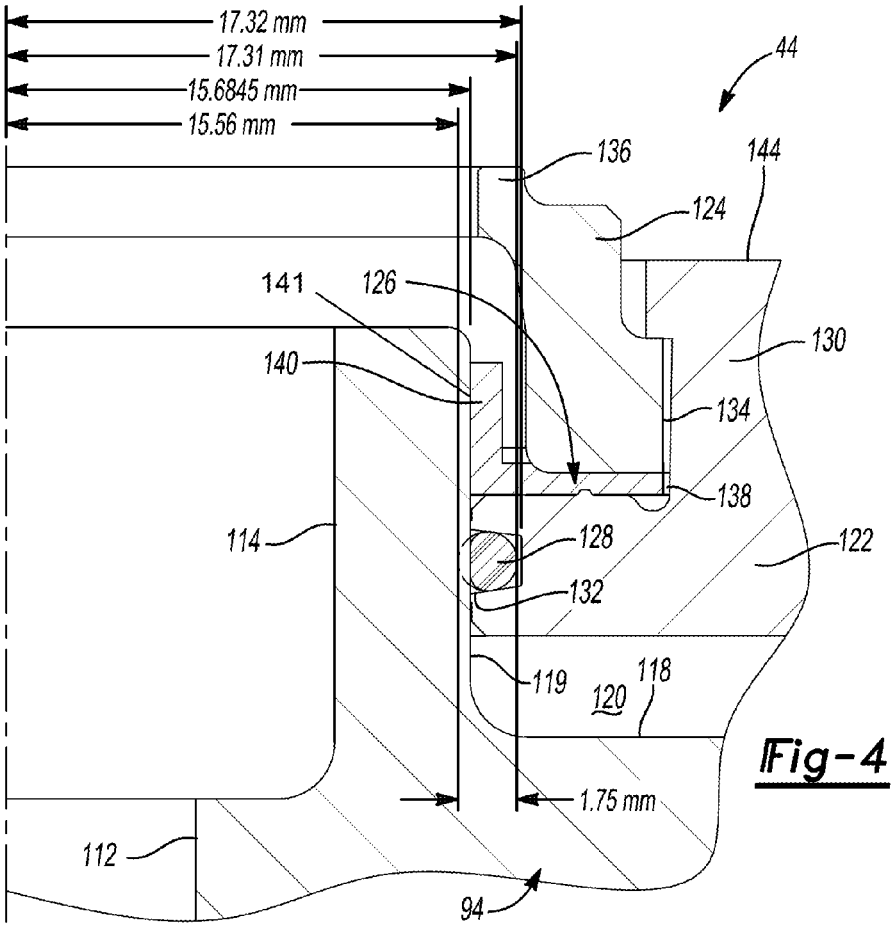
FIG. 4 is a partial cross-sectional view of the seal assembly of FIG. 2.
Figure 5:
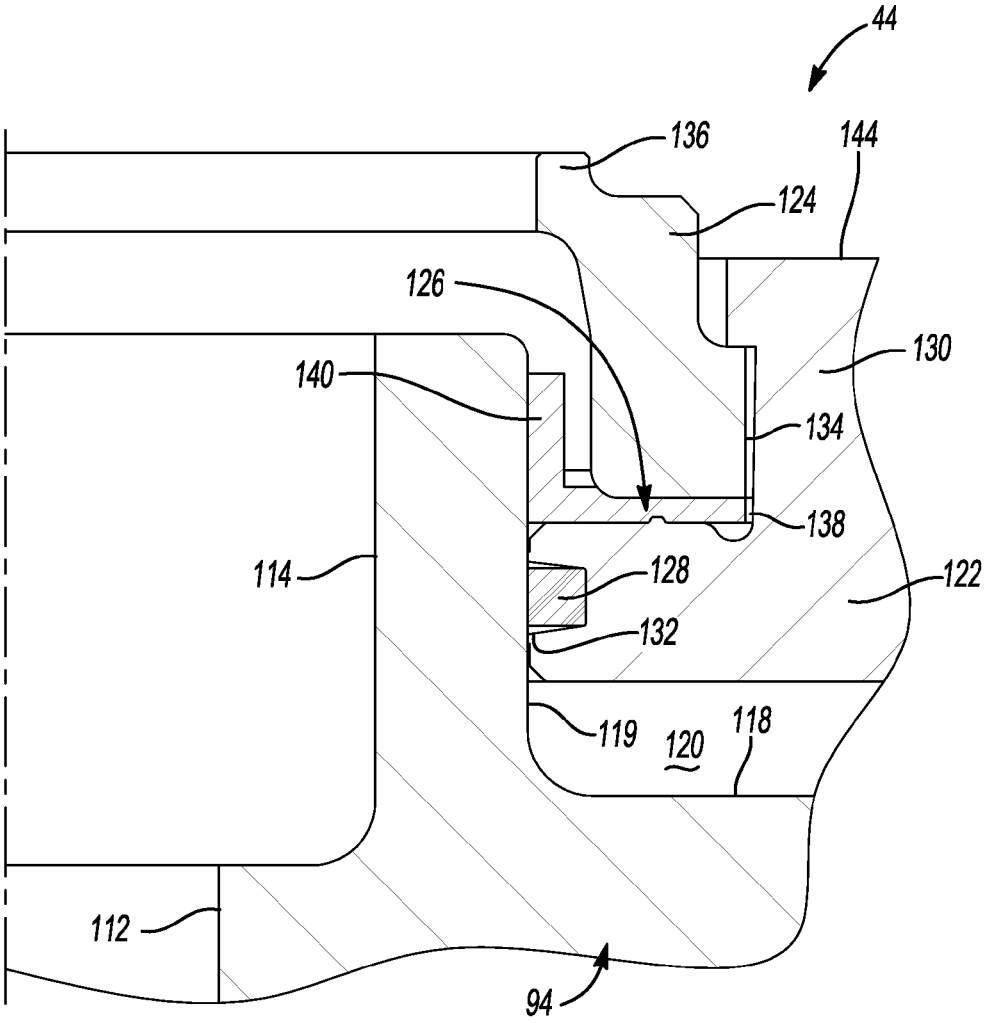
FIG. 5 is a partial cross-sectional view of another seal assembly according to the principles of the present disclosure.

The second annular sealing member 128 may include an O-ring or other seal and may sealingly engage the inner surface 119 of the annular recess 118 and the annular groove 132 in the annular base plate 122. The second annular sealing member 128 may be formed from hydrogenated nitrile butadiene rubber, for example, or any other suitable elastomer or polymer. In some embodiments, the second annular sealing member 128 may include a substantially circular cross section (FIG. 4). In other embodiments, the second annular sealing member 128 may include a substantially square, rectangular or other polygonal cross section (FIG. 5). In other embodiments, the second annular sealing member 128 may include a D-shaped cross-section, for example, or any other suitable cross-sectional shape.

In some configurations, the second annular sealing member 128 may include an outer diameter of between about thirty-four (34) and thirty-five (35) millimeters, an inner diameter of between about thirty-one (31) and thirty-two (32) millimeters, and may include a thickness of between about one (1) and two (2) millimeters. In other embodiments, the second annular sealing member 128 may include a different thickness, inner diameter and/or outer diameter than those described above to suit a given application.

The sealed relationship between the second annular sealing member 128 and the inner surface 119 of the annular recess 118 and between the annular groove 132 and the second annular sealing member 128 may be sufficiently robust to maintain its integrity up to a predetermined pressure-differential threshold across the second annular sealing member 128 and allow leakage past the second annular sealing member 128 when the pressure differential is greater than the predetermined pressure-differential threshold. For example, the second annular sealing member 128 may be configured to allow leakage of liquid refrigerant out of the biasing chamber 120 following compressor start-up.

With continued reference to FIGS. 1-5, operation of the heat pump system 10 will be described in detail. As described above, the heat pump system 10 is operable to circulate the working fluid between the indoor and outdoor units 12, 14 to heat or cool a space on demand. The reversing valve 34 may control a direction of fluid flow between the compressor 26 and the indoor and outdoor heat exchangers 18, 28. In a first fluid-flow direction, the heat pump system 10 may operate in a cooling mode in which the working fluid flows in a direction indicated in FIG. 1 by the "cooling" arrow. In the cooling mode, compressed working fluid may flow from the compressor 26 to the outdoor heat exchanger 28, where heat is rejected from the working fluid to the ambient air. From the outdoor heat exchanger 28, the working fluid may flow through the expansion device 23 to the indoor heat exchanger 18, where the working fluid absorbs heat from the ambient air. The working fluid may then flow from the indoor heat exchanger 18 back to the compressor 26. In the cooling mode, the indoor heat exchanger 18 may function as an evaporator and the outdoor heat exchanger 28 may function as a condenser.

In a second fluid-flow direction, the heat pump system 10 may operate in a heating mode in which the working fluid flows in a direction indicated in FIG. 1 by the "heating" arrow. In the heating mode, compressed working fluid may flow from the compressor 26 to the indoor heat exchanger 18, where heat from the working fluid is rejected to the ambient air. From the indoor heat exchanger 18, the working fluid may flow through the expansion device 23 to the outdoor heat exchanger 28, where the working fluid absorbs heat from the ambient air. The working fluid may then flow from the outdoor heat exchanger 28 back to the compressor 26. In the heating mode, the indoor heat exchanger 18 may function as a condenser and the outdoor heat exchanger 28 may function as an evaporator.

During operation of the heat pump system 10 in the heating mode, frost and/or ice may accumulate on the coil of the outdoor heat exchanger 28 which may hinder heat transfer between the working fluid therein and the ambient air surrounding the outdoor heat exchanger 28. To remove the frost and/or ice, a system controller (not shown) may initiate a defrost mode, which temporarily switches operation of the heat pump system 10 from the heating mode to the cooling mode such that hot working fluid flows through the outdoor heat exchanger 28 and melts the frost and/or ice. Once the ice is melted, the controller may switch operation of the heat pump system 10 back to the heating mode.

Similarly, frost and/or ice may accumulate on the indoor heat exchanger 18 during operation of the heat pump system 10 in the cooling mode. The controller may initiate the defrost mode by switching the heat pump system 10 to the heating mode so that hot working fluid may flow through the indoor heat exchanger 18 to melt the frost and/or ice.

During steady-state or normal operation of the heat pump system 10 in either the heating or cooling mode, fluid in the discharge chamber 62 may be at discharge pressure and fluid in the suction chamber 63 may be at suction pressure. The fluid disposed within the biasing chamber 120 may be at an intermediate pressure that is less than discharge pressure and greater than suction pressure.

The pressure differential between the biasing chamber 120 and the suction chamber 63 may force the outer portion 142 of the first annular sealing member 126 outward and upward into sealing engagement with the outer surface 121 of the annular recess 118. The pressure differential between the discharge chamber 62 (and discharge recess 114) and the biasing chamber 120 forces the inner portion 140 of the first annular sealing member 126 radially inward into sealing engagement with the inner surface 119 of the annular recess 118. In this manner, the first annular sealing member 126 may fluidly isolate the biasing chamber 120 from the discharge chamber 62 and the suction chamber 63. As described above, the pressure differential between the biasing chamber 120 and the suction chamber 63 forces the seal assembly 44 upward such that the lip portion 136 of the third annular sealing member 124 may sealingly engage the wear ring 64 to fluidly isolate the discharge chamber 62 from the suction chamber 63.

Switching the heat pump system 10 between the heating and cooling modes to defrost the heat pump system 10 may cause a temporary loss of pressure in the discharge chamber 62 and/or a temporary increase in pressure in the suction chamber 63 as the heat pump system 10 transitions between the heating and cooling modes. Such pressure changes may result in a substantially balanced-pressure condition, whereby fluid pressures in the discharge chamber 62 and in the suction chamber 63 may be equal or nearly equal and may be less than the fluid pressure within the biasing chamber 120.

The lack of fluid pressure in the discharge chamber 62 may allow a leakage path to form between the inner portion 140 of the first annular sealing member 126 and the inner surface 119 of the annular recess 118. Because the second annular sealing member 128 does not rely on a pressure differential to sealingly engage the annular groove 132 and the inner surface 119 of the annular recess 118, fluid from the biasing chamber 120 is prevented from flowing into the discharge chamber 62 as long as the pressure differential therebetween is less than a predetermined threshold. Because the biasing chamber 120 remains sealed even during the transitional period immediately following a switch between the heating and cooling modes, a pressure differential between the biasing chamber 120 and the suction chamber 63 is maintained. As described above, this pressure differential exerts an axial biasing force on the non-orbiting scroll 94 to keep the spiral wraps 110, 98 sealed against the respective end plates 96, 108. Maintaining a sufficiently strong biasing force on the non-orbiting scroll 94 prevents unintended axial separation between the orbiting and non-orbiting scrolls 92, 94 during compressor start-up and/or the transitional period following a switch between the heating and cooling modes, thereby eliminating undesirable noise due to vibration between the orbiting and non-orbiting scrolls 92, 94.

Figure 6:
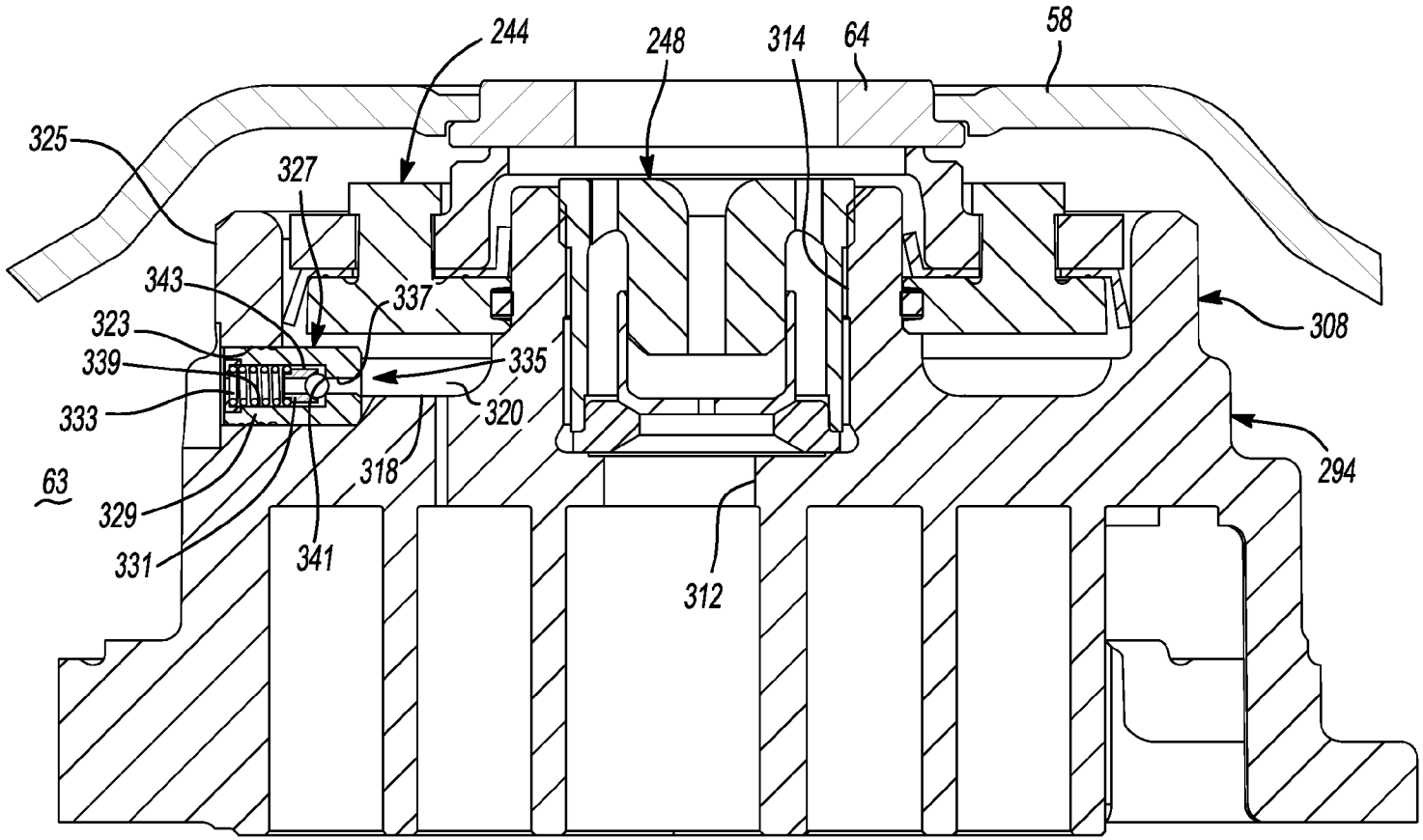
FIG. 6 is a partial cross-sectional view of a non-orbiting scroll and seal assembly according to the principles of the present disclosure.

With reference to FIG. 6, another non-orbiting scroll 294 and seal assembly 244 are provided. The non-orbiting scroll 294 and seal assembly 244 may be incorporated into the compressor 26. The structure and function of the non-orbiting scroll 294 and seal assembly 244 may be substantially similar to the non-orbiting scroll 94 and seal assembly 44 described above, apart from any exceptions noted below. Similar to the non-orbiting scroll 94 of the compressor 26, the non-orbiting scroll 294 may include an end plate 308 having a discharge recess 314 and an annular recess 318. A discharge valve 248 may be disposed within the discharge recess 314 and may be in communication with a discharge passage 312. A radially extending bore 323 may extend between an outer circumferential surface 325 and the annular recess 318. The seal assembly 244 may be at least partially received in the recess 318 to form a biasing chamber 320 therebetween.

A valve assembly 327 may engage the radially extending bore 323 and may control communication between the biasing chamber 320 and the suction chamber 63. The valve assembly 327 may include a valve housing 329, a valve member 331 and a biasing member 333. The valve housing 329 may include a bore 335 extending therethrough. The bore 335 may include a first portion 337 and a second portion 339. The valve member 331 and the biasing member 333 may be arranged in the second portion 339 such that the biasing member 333 biases the valve member 331 toward a valve seat 341 disposed between the first and second portions 337, 339.

The valve member 331 may include one or more ports 343 in communication with the second portion 339 and selective communication with the first portion 337. The valve member 331 may be movable between an open position and a closed position. In the open position, the valve member 331 may be spaced apart from the valve seat 341 to allow fluid to flow through the one or more ports 343 in the valve member 331 and through the bore 335 from the biasing chamber 320 to the suction chamber 63. In the closed position, the biasing member 333 may urge the valve member 331 into engagement with the valve seat 341 to block or restrict fluid-flow through the bore 335 between the biasing chamber 320 and the suction chamber 63.

A fluid pressure within the biasing chamber 320 may spike or rise during start up of the compressor 26 (i.e., a flooded start condition) and/or when the heat pump system 10 switches into or out of the defrost mode. When the fluid pressure within the biasing chamber 320 rises relative to a fluid pressure in the suction chamber 63 such that a pressure differential therebetween reaches a predetermined magnitude, the pressure of the fluid within the biasing chamber 320 may overcome the biasing force of the biasing member 333 and force the valve member 331 into the open position to allow a portion of the fluid in the biasing chamber 320 to bleed-off into the suction chamber 63.

In other embodiments, the valve housing 329, the valve member 331 and/or the biasing member 333 could be structured and/or arranged in any other suitable manner. In some embodiments, the valve assembly 327 could be a solenoid valve, for example, or any other electromechanical device.

Figure 7:
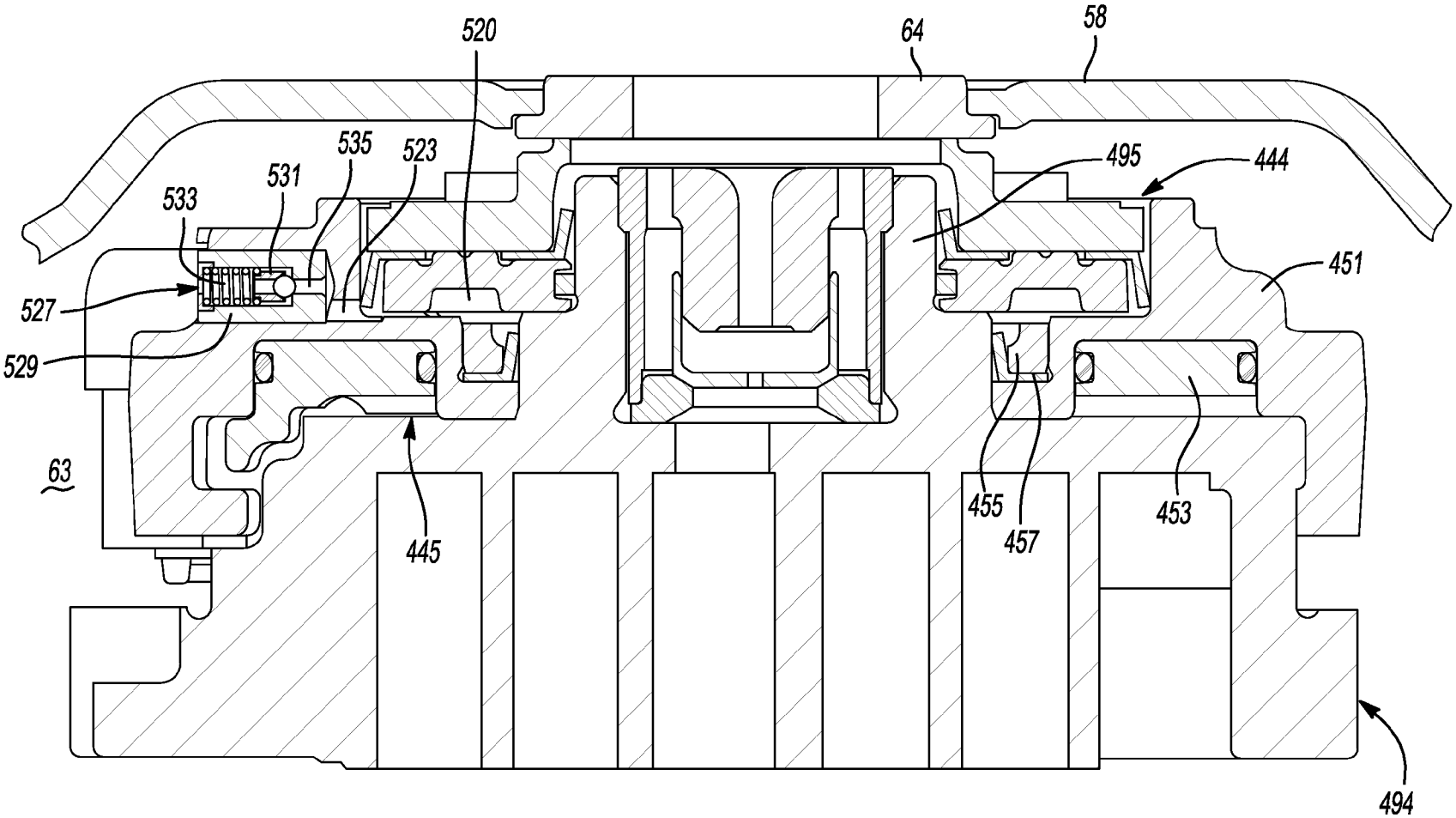
FIG. 7 is a partial cross-sectional view of another non-orbiting scroll and seal assembly according to the principles of the present disclosure.

With reference to FIG. 7, another non-orbiting scroll 494 and seal assembly 444 are provided. The non-orbiting scroll 494 and seal assembly 444 may be incorporated into the compressor 26. The structure and function of the non-orbiting scroll 494 and seal assembly 444 may be substantially similar to the non-orbiting scroll 94 and seal assembly 44 described above, apart from any exceptions noted below. A capacity modulation assembly 445 and the seal assembly 444 may engage a central hub 495 of the non-orbiting scroll 494. The capacity modulation assembly 445 and the seal assembly 444 may cooperate to define a biasing chamber 520 therebetween. The capacity modulation assembly 445 may include a modulation valve ring 451, a modulation lift ring 453, a retaining ring 455, and a seal member 457 engaging the retaining ring 455 and the central hub 495. The modulation valve ring 451 may be movable in an axial direction to selectively open and close a leakage path (not shown) through which partially compressed fluid can be exhausted to the suction chamber 63, thereby modulating a capacity of the compressor 26.

The modulation valve ring 451 may include a bore 523 extending radially therethrough between the suction chamber 63 and the biasing chamber 520. A valve assembly 527 may engage the bore 523 and control communication between the biasing chamber 520 and the suction chamber 63. The structure and function of the valve assembly 527 may be substantially similar to the valve assembly 327 described above, and therefore, will not be described again in detail. Briefly, the valve assembly 527 may include a valve member 531 and a biasing member 533 disposed in a valve housing 529. The valve member 531 may be movable between open and closed positions. In the closed position, the valve member 531 may block or restrict a flow-fluid through a bore 535 in the valve housing 529 between the biasing chamber 520 and the suction chamber 63. In the open position, the valve member 531 may allow fluid-flow through the bore 535 from the biasing chamber 520 to the suction chamber 63 in response to a pressure differential therebetween reaching a predetermined magnitude when the compressor 26 starts-up and/or when the heat pump system 10 is switched into or out of the defrost mode, for example.

Figure 8:
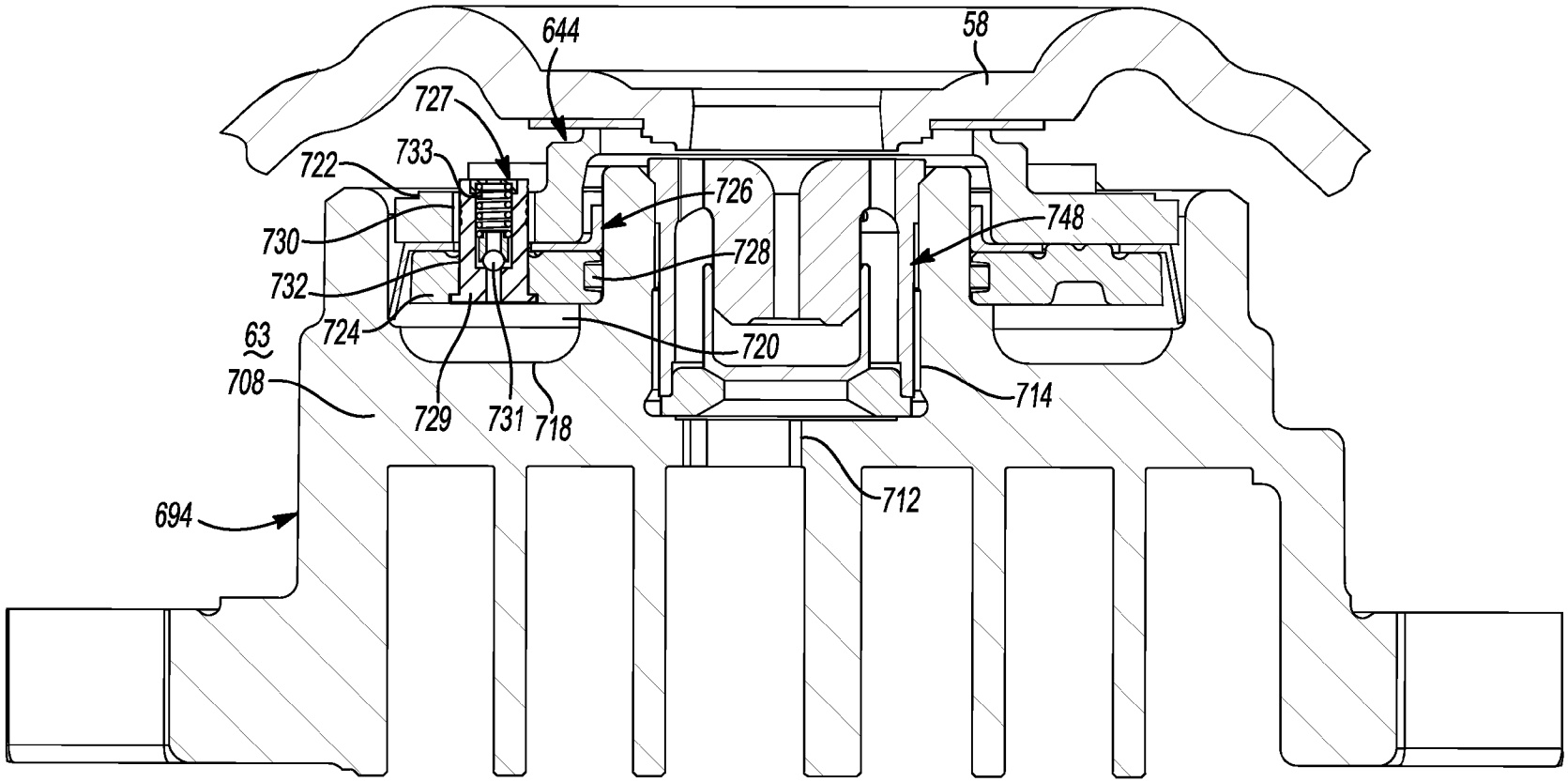

With reference to FIG. 8, another non-orbiting scroll 694 and seal assembly 644 are provided. The non-orbiting scroll 694 and seal assembly 644 may be incorporated into the compressor 26. The structure and function of the non-orbiting scroll 694 and seal assembly 644 may be substantially similar to the non-orbiting scroll 94 and seal assembly 44 described above, apart from any exceptions noted below. Similar to the non-orbiting scroll 94, the non-orbiting scroll 694 may include an end plate 708 having a discharge recess 714 and an annular recess 718. A discharge valve 748 may be disposed within the discharge recess 714 and may be in communication with a discharge passage 712.

The seal assembly 644 may be at least partially received in the recess 718 to form a biasing chamber 720 therebetween. Similar to the seal assembly 44 described above, the seal assembly 644 may include an annular base plate 722, a first annular sealing member 726, a second annular sealing member 728, and a third annular sealing member 724. The annular base plate 722 may include a first passage 730. The third annular sealing member 724 may include a second passage 732 that is generally aligned with the first passage 730.

A valve assembly 727 may engage the first and second aperture 730, 732. The valve assembly 727 may be substantially similar in structure and function as the valve assembly 327 described above, and therefore, will not be described again in detail. Briefly, the valve assembly 727 may include a valve housing 729, a valve member 731 and a biasing member 733. The valve housing 729 may threadably engage or be press-fit, for example, into the first and/or second aperture 730, 732. The valve member 731 may be movable relative to the valve housing 729 between an open position and a closed position to control fluid communication between the biasing chamber 720 and the suction chamber 63. The biasing member 733 may bias the valve member 731 toward the closed position.

The valve member 731 may move into the open position in response to a predetermined pressure differential between the biasing chamber 720 and the suction chamber 63. For example, the biasing member 733 may be configured to allow the valve member 731 to move into the open position when a fluid pressure within the biasing chamber 720 is about one-hundred-fifty pounds per square inch greater than a fluid pressure in the suction chamber 63. Such a spike or rise in fluid-pressure differential may occur during start up of the compressor 26 (e.g., a flooded start condition) and/or when the heat pump system 10 switches into or out of the defrost mode, for example. Movement of the valve member 731 into the open position allows fluid to flow out of the biasing chamber 720 and into the suction chamber 63 until the fluid-pressure differential therebetween is less than the predetermined pressure differential, at which time the biasing force of the biasing member 733 may be sufficient to urge the valve member 731 back to the closed position to restrict or prevent fluid communication between the biasing chamber 720 and the suction chamber 63.

While the valve assembly 727 is described above as extending through the seal assembly 644 and including the valve housing 729, the valve member 731 and the biasing member 733, in some embodiments, the valve assembly 727 could be otherwise configured and/or located to provide selective fluid communication between the biasing chamber 720 and the suction chamber 63.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell defining a first pressure region and a second pressure region;

a first scroll member disposed within said shell and including a first end plate and a first scroll wrap, said first end plate defining a discharge passage in communication with said second pressure region;

a second scroll member including a second end plate and a second scroll wrap, said second scroll wrap meshingly engaging said first scroll wrap to define a compression chamber therebetween; and a seal assembly defining a biasing chamber and surrounding said discharge passage and fluidly separating said first and second pressure regions from each other, said biasing chamber containing fluid biasing said first scroll member toward said second scroll member, said seal assembly including a first sealing member and a second sealing member, said first sealing member restricting communication between said biasing chamber and said second pressure region when a first fluid pressure within said second pressure region is higher than a second fluid pressure within said biasing chamber, said first sealing member sealing against said first scroll member when said first fluid pressure is greater than said second fluid pressure, said first sealing member and said first scroll member defining a leakage path therebetween when said first fluid pressure is lower than said second fluid pressure, said second sealing member fluidly separating said biasing chamber and said second pressure region when said first fluid pressure is lower than said second fluid pressure.

2. The compressor of claim 1, wherein said first and second pressure regions are at suction and discharge pressures, respectively, during steady-state operation of the compressor.

3. The compressor of claim 2, wherein said biasing chamber is at an intermediate pressure between said suction and discharge pressures during steady-state operation of the compressor.

4. A system comprising the compressor of claim 1, first and second heat exchangers, and a reversing valve, said compressor circulating a working fluid between said first and second heat exchangers, said reversing valve controlling a direction of fluid flow between said first and second heat exchangers, wherein switching said direction of fluid flow reduces said first fluid pressure within said second pressure region below a third fluid pressure within said biasing chamber and opens said leakage path through said first sealing member.

5. The compressor of claim 1, further comprising an annular member attached to said first sealing member and defining said biasing chamber, said annular member having an annular groove at least partially receiving said second sealing member.

6. The compressor of claim 1, wherein said second sealing member includes an annular ring having a cross section with a linear side.

7. The compressor of claim 6, wherein said second sealing member includes a polygonal cross section.

8. The compressor of claim 7, wherein said second sealing member includes a rectangular cross section.

9. The compressor of claim 1, wherein said second sealing member includes hydrogenated nitrile butadiene rubber.

10. The compressor of claim 1, further comprising a valve member in communication with said biasing chamber and movable between a first position restricting communication between said biasing chamber and said first pressure region and a second position allowing communication between said biasing chamber and said first pressure region.

11. The compressor of claim 10, wherein said valve member moves from said first position to said second position in response to a fluid-pressure differential between said first pressure region and said biasing chamber reaching a predetermined magnitude.

12. The compressor of claim 1, wherein said second sealing member allows communication between said biasing chamber and said second pressure region when a fluid pressure within said biasing chamber is a predetermined amount greater than a pressure within said second pressure region.

13. A compressor comprising:

a shell defining a first pressure region and a second pressure region;

a first scroll member disposed within said shell and including a first end plate and a first scroll wrap, said first end plate defining a discharge passage in communication with said second pressure region;

a second scroll member including a second end plate and a second scroll wrap, said second scroll wrap meshingly engaging said first scroll wrap to define a compression chamber therebetween; and a seal assembly defining a biasing chamber and surrounding said discharge passage and fluidly separating said first and second pressure regions from each other, said biasing chamber containing fluid biasing said first scroll member toward said second scroll member, said seal assembly including a first sealing member and a second sealing member, said first sealing member restricting communication between said biasing chamber and said second pressure region when a first fluid pressure within said second pressure region is higher than a second fluid pressure within said biasing chamber, said first sealing member defining a leakage path when said first fluid pressure is lower than said second fluid pressure, said second sealing member fluidly separating said biasing chamber and said second pressure region when said first fluid pressure is lower than said second fluid pressure, wherein said second sealing member allows communication between said biasing chamber and said second pressure region when a fluid pressure within said biasing chamber is a predetermined amount greater than a pressure within said second pressure region.

14. The compressor of claim 13, wherein said first and second pressure regions are at suction and discharge pressures, respectively, during steady-state operation of the compressor.

15. The compressor of claim 14, wherein said biasing chamber is at an intermediate pressure between said suction and discharge pressures during steady-state operation of the compressor.

16. The compressor of claim 13, further comprising an annular member attached to said first sealing member and defining said biasing chamber, said annular member having an annular groove at least partially receiving said second sealing member.

17. The compressor of claim 13, wherein said second sealing member includes an annular ring having a cross section with a linear side.

18. The compressor of claim 17, wherein said second sealing member includes a polygonal cross section.

19. The compressor of claim 18, wherein said second sealing member includes a rectangular cross section.

20. The compressor of claim 13, further comprising a valve member in communication with said biasing chamber and movable between a first position restricting communication between said biasing chamber and said first pressure region and a second position allowing communication between said biasing chamber and said first pressure region.

21. The compressor of claim 20, wherein said valve member moves from said first position to said second position in response to a fluid-pressure differential between said first pressure region and said biasing chamber reaching a predetermined magnitude.

22. A method comprising:

providing a fluid circulation system including a compressor, an indoor heat exchanger, and an outdoor heat exchanger, said compressor including first and second pressure regions, a first scroll member and a second scroll member meshingly engaging said first scroll member, said first scroll member defining a discharge passage in communication with said second pressure region;

providing a seal assembly defining a fluid chamber, said seal assembly including first and second sealing members;

fluidly separating said second pressure region from said fluid chamber using said first sealing member when said compressor is operating in a steady-state condition;

operating said compressor in a transitional condition in which said second pressure region is at a fluid pressure that is less than a fluid pressure of said first pressure region;

providing a leakage path around said first sealing member when said compressor is operating in said transitional condition; and fluidly separating said second pressure region from said fluid chamber using said second sealing member when said compressor is operating in said transitional condition.

23. The method of claim 22, wherein operating said compressor in said transitional condition follows at least one of a compressor start-up and a change in fluid-flow direction through said fluid circulation system.

24. The method of claim 23, wherein said change in fluid-flow direction includes switching said fluid circulation system between a heating mode and a cooling mode.

25. The method of claim 22, further comprising supplying partially compressed fluid in said fluid chamber, said partially compressed fluid axially biasing said first scroll member toward said second scroll member.

26. The method of claim 22, wherein said seal assembly includes an annular seal plate having a groove, and wherein said second sealing member includes an annular seal that is received in said groove.

27. The method of claim 22, wherein said second sealing member includes hydrogenated nitrile butadiene rubber.

28. The method of claim 22, further comprising providing a valve member in communication with said fluid chamber and moving said valve member between a first position restricting communication between said fluid chamber and said first pressure region and a second position allowing communication between said fluid chamber and said first pressure region.

29. The method of claim 28, wherein said valve member moves from said first position to said second position in response to a fluid-pressure differential between said first pressure region and said fluid chamber reaching a predetermined magnitude.

* * * * *